United States Patent [19]

Inoue et al.

[11] Patent Number: 4,835,091

[45] Date of Patent: May 30, 1989

[54] PROCESS FOR FORMING A DIRECT POSITIVE IMAGE

[75] Inventors: Noriyuki Inoue; Tatsuo Heki; Shigeo Hirano, all of Minami-Ashigara, Japan

[73] Assignee: Fuji Photo Film Co., Ltd., Kanagawa, Japan

[21] Appl. No.: 65,353

[22] Filed: Jun. 23, 1987

[30] Foreign Application Priority Data

Jun. 25, 1986 [JP] Japan ..... 61-149086

[51] Int. Cl.[4] ..... G03C 5/50; G03C 7/30

[52] U.S. Cl. ..... 430/378; 430/409; 430/410

[58] Field of Search ..... 430/409, 410, 378

[56] References Cited

U.S. PATENT DOCUMENTS

| | | | |
|---|---|---|---|
| 3,565,620 | 2/1971 | Willems et al. | 430/410 |
| 4,094,683 | 6/1978 | Tsujino et al. | 96/95 |
| 4,115,122 | 9/1978 | Adachi et al. | 96/76 |
| 4,245,037 | 1/1981 | Tsujino et al. | 430/559 |
| 4,255,511 | 3/1981 | Hirano et al. | 430/217 |
| 4,294,919 | 10/1981 | Tsujino et al. | 430/559 |
| 4,324,855 | 4/1982 | Oishi et al. | 430/378 |
| 4,358,528 | 11/1982 | Takagi et al. | 430/251 |
| 4,374,923 | 2/1983 | Hirano et al. | 430/410 |
| 4,444,871 | 4/1984 | Miyaoka et al. | |
| 4,540,655 | 9/1985 | Takagi et al. | 430/410 |

FOREIGN PATENT DOCUMENTS

| | | |
|---|---|---|
| 46-22515 | 6/1971 | Japan . |
| 2012443 | 7/1979 | United Kingdom . |

*Primary Examiner*—Richard L. Schilling

*Attorney, Agent, or Firm*—Burns, Doane, Swecker & Mathis

[57] ABSTRACT

A process for forming a direct positive image which comprises image-wise exposing a light-sensitive material comprising a support having provided thereon at least one internal latent image type direct positive silver halide photographic emulsion layer, subjecting the selecting material to whole surface exposure before or during developing process, and then developing the resulting material in the presence of a quaternary salt type nucleating agent or a hydrazine type nucleating agent.

The process is very high in the latitude for changes of expose amount, developing time, developing solution components, process temperature and the like and makes it possible to progress the development is a short time even in a low pH developing solution.

20 Claims, No Drawings

PROCESS FOR FORMING A DIRECT POSITIVE IMAGE

BACKGROUND OF THE INVENTION

1. Field of the Invention

The present invention relates to a process for forming an image by developing a direct positive silver halide photographic light-sensitive material to obtain a direct positive image.

2. Description of the Prior Art

Photographic methods for obtaining a direct positive image without need of a reversal process step or a negative film have been well known.

Known methods for forming a positive image by using a direct positive silver halide photographic light-sensitive material can be classified mainly into two types considering practical usefulness.

One is a method for obtaining a direct positive image by using pre-fogged silver halide emulsions and destroying the fog nucleus of exposed areas (a latent image) by utilizing solarization, Harschel effects or the like.

The other is a method for obtaining a direct positive image by imagewise exposing to light photographic materials using internal latent image type silver halide emulsions which have not previously been fogged followed by surface development during or after fogging process. In this connection, the above-mentioned internal latent image type silver halide photographic emulsion means a silver halide photographic emulsion which has light-sensitive nucleus mainly inside the silver halide grains and by exposure of which emulsion a latent image is formed mainly inside the grains.

Methods of the latter type generally have higher sensitivity than those of the former type, and are suitable for uses wherein high sensitivity is required. The present invention relates to the latter type method.

Various techniques have hitherto been known in this technical field. Main such techniques and disclosed, for example, in each specification of U.S. Pat. Nos. 2,592,250, 2,466,957, 2,497,875, 2,588,982, 3,317,322, 3,761,266, 3,761,276 and 3,796,577, and U.K. Pat. Nos. 1,151,363, 1,150,553 and 1,011,062.

Photographic light-sensitive materials of relatively high sensitivity as direct positive type can be prepared by using these known methods.

Further, the mechanism of direct positive image formation is disclosed in detail, for example, in T. H. James, The Theory of The Photographic Process vol. 4, chapter 7, pages 182 to 193, U.S. Pat. No. 3,761,276 and the like. According to the disclosures, it is believed that fog nuclei are formed selectively on the surface of the silver halide grains of non-exposed areas based on a surface desensitizing action owing to internal latent images formed by the first imagewise exposure, and then a photographic image (direct positive image) is formed on the non-exposed areas by conducting a usual so-called surface developing process.

In the above-mentioned, as methods for selectively forming fog nuclei, a method generally called "light fogging method" wherein the second exposure is given on the whole surface of the light-sensitive layers (for example, U.K. Pat. No. 1,151,363) and a method generally called "chemically fogging method" wherein nucleating agents are used have been known. The latter method is disclosed, for example, Research Disclosure, vol. 151, No. 15,162 (published in November, 1976), pages 76 to 78.

Light fogging methods have disadvantages in that properties of a finished product of a light-sensitive material are liable to change depending upon change in exposure amount, development time, developing solution components, processing temperature and the like.

On the other hand, chemically fogging methods have disadvantages in that the methods must be carried out in high pH conditions which lead to deterioration of a developing agent by air oxidation, which in turn leads to reduction of fogging effect.

Japanese Published Examined Patent Application No. 22515/1971 discloses a method for forming a direct positive color image by using low intensity whole surface exposure and a nucleating agent together, but there is no specific disclosure about the nucleating agent.

SUMMARY OF THE INVENTION

Therefore, the purpose of the present invention is to provide a method for forming a direct positive image, in which an excellent direct positive image can be formed even when expose amount, development time, developing solution components, processing temperature and the like are changed and the development can be conducted in a short time even in a low pH developing solution.

The above-mentioned purpose of the present invention can be attained by imagewise exposing to light a light-sensitive material having at least one internal latent image type direct positive silver halide photographic emulsion layer on a support, giving the resulting material whole surface exposure before a during developing process, and developing the resulting material in the presence of a quaternary salt type nucleating agent or a hydrazine type nucleating agent.

DETAILED DESCRIPTION OF THE INVENTION

The internal latent image type silver halide emulsion which has not been fogged in advance as used in the present invention is an emulsion containing silver halide grains, surface of which has not been fogged in advance and inside which a latent image is formed mainly. More specifically, the silver halide emulsion used in the present invention is an emulsion that the maximum photographic density of an emulsion obtained by coating a silver halide emulsion in an amount of 0.5–3 g/m$^2$ on a transparent substrate, giving exposure to the emulsion for a fixed time of 0.01 to 10 seconds and then developing the emulsion in the following developing solution A (internal developing solution) at 18° C. for 5 minutes, which density is measured according to a usual method for measuring photographic concentration, is at least 5 times, preferably at least 10 times the maximum photographic density of an emulsion obtained by coating the same amount of the silver halide emulsion as above on the substrate, giving exposure to the emulsion for the same time as above and them developing the emulsion in the following developing solution B (surface developing solution) at 20° C. for 6 minutes, which density is measured in the same manner as above.

Internal developing solution A

Metol: 2 g
Sodium sulfite (anhydride): 90 g
Hydroquinone: 8 g
Sodium carbonate (monohydrate): 52.5 g KBr: 5 g
KI: 0.5 g
Water to: 1 l Surface developing solution B Metol: 2.5 g
l-Ascorbic acid: 10 g
$NaBO_2.4H_2O$: 35 g
KBr: 1 g
Water to: 1

Specific examples of the internal latent image type emulsion include a conversion type silver halide emulsion and core/shell type silver halide emulsion. The core/shell type silver halide emulsions include emulsions disclosed in Japanese Published Unexamined Patent Application Nos. 32813/1972, 32814/1972, 134721/1977, 156614/1977, 60222/1978, 66218/1978, 66727/1978, 127549/1980, 136641/1982, 70221/1983, 208540/1984, 216136/1984, 107641/1985, 247237/1985, 2148/1986 and 3137/1986; Japanese Published Examined Patent Application Nos. 18939/1981, 1412/1983, 1415/1983, 6935/1983 and 108528/1983; Japanese Patent Application No. 36424/1986; U.S. Pat. Nos. 3,206,313, 3,317,322, 3,761,266, 3,761,276, 3,850,637, 3,923,513, 4,035,185, 4,395,478 and 4,504,570; EP No. 0017148; Research Disclosure RD 16345 (published in November, 1977) and the like.

Typical silver halides include mixed silver halide such as silver chlorobromide, silver chloroiodobromide and silver iodobromide in addition to silver chloride and silver bromide. Silver halide preferably used in the present invention are silver chloro(iodo)bromide, silver (iodo)chloride and silver (iodo)bromide, which contain no silver iodide or 3 mole % or less of silver iodide.

Preferred average grain size of silver halide grains is 0.1 to 2$\mu$, especially 0.15 to 1$\mu$. In this connection, the grain size means grain diameter in case of spherical or sphere-like grains and edge length in case of cubic grains, respectively, and is represented as average length based on projective area. Grain size distribution may be narrow or wide. However, from the viewpoint of improvement of graininess, sharpness and the like, it is preferable to use a so-called "monodispersed" silver halide emulsion having a narrow grain size distribution that 90% or more, especially 95% or more by grain number or by weight of total grains are fallen within ±40%, preferably within ±30%, particularly within ±20% of the average grain size. Further, in order to obtain light-sensitive materials which give desired gradation, two or more monodispersed silver halide emulsions containing different-sized grains, or plural kinds of grains having the same sizes but different speed are incorporated in the same or different layers having substantially the same color sensitivity. Further, it is also possible to use combination of two or more multidispersed silver halide emulsions or combination of a monodispersed emulsion with a multi-dispersed emulsion in a mixture or in piles.

Silver halide grains used in the present invention may have regular crystal shapes such as cubes, octahedrons, dodecahedrons and tetradecahedrons, irregular crystal shapes such as spheres, or their combinated shapes. Further, it is possible to use an emulsion containing tabular grains, especially an emulsion containing tabular grains having the length/thickness ratio of 5 or more, especially 8 or more in an amount of 50% or more of the total projected surface areas of the grains. Further it is possible to use an emulsion containing a mixture of these various crystals.

Silver halide emulsions used in the present invention may be chemically sensitized inside or on the surface of the grains according to a method of sulfur or selenium sensitization, reduction sensitization, noble metal sensitization and the like alone or in combination.

Photographic emulsions used in the present invention may be spectrally sensitized with photographic sensitizing dyes in a conventional manner. Especially useful dyes are cyanine dyes, merocyanine dyes and composite merocyanine dyes. There dyes may be used alone or in combination. Further, it is possible to use the above dyes and supersensitizing agents together. Detailed specific examples thereof and methods for using them are disclosed, for example, in Research Disclosure No. 17,643 (December, 1978) IV, etc.

Various compounds can be contained in the photographic emulsion used in the present invention for the purpose of preventing fog of the light-sensitive materials during preparation, preservation or photographic process, promoting development or stabilizing photographic performance. Such antifoggants or stabilizers include azoles, mercapto compounds, thiocarbonyl compounds, azaindenes such as tetrazaindenes, preferably 4-hydroxy-6-methyl-(1,3,3a,7) tetrazaindene; benzenesulfonamides, purines such as adenine, etc.; triazines, phthalazinones, all of which are known for such purposes.

More specifically, the azoles include triazoles, imidazoles, indazoles, triaziazoles and the like, and the mercapto compounds include mercaptotetrazoles, for example, 1-phenyl-5-mercaptotetrazole typically represented by the following formula:

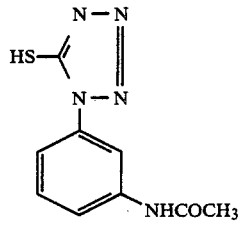

Specific examples of antifoggants or stabilizers and use methods thereof are disclosed more in detail in U.S. Pat. Nos. 3,954,474 and 3,982,947, Japanese Published Examined Patent Application No. 28660/1977, Research Disclosure No. 17,643 (published in December, 1978), VIA-VIM, B. J. Birr, "Stabilization of Photographic Silver Halide Emulsions" (Focal Press, published in 1974) and the like.

Nucleating agents used in the present invention may be contained in the light-sensitive materials or processing solutions thereof, preferably in the light-sensitive materials.

In case of addition to light-sensitive materials, nucleating agents are, preferably added to an internal latent image type silver halide emulsion layer. However, they may also be added to other layers such as an intermediate layer, a substratum layer and back layer, so long as they diffuse during coating or during processing and are adsorbed on silver halide. In case of addition to a processing solution, nucleating agents are added to a developing solution, a low pH pre-bath as disclosed in Japanese Published Unexamined Patent Application No. 178350/1983 and the like.

Whole surface expoure, i.e. fogging exposure in the present invention is carried out before and/or during developing process after the imagewise exposure. The light-sensitive material imagewise exposed is exposed to light in a developing solution on a pre-bath thereof or in a wet state taken out from these solutions, preferably in a developing solution.

As a light source of the fogging exposure, light sources emitting light of the wavelength within the light-sensitive wavelength of the light-sensitive material, for example, a fluorescent lamp, a tungsten, a xenon lamp, sunlight, etc. may be used. In light-sensitive materials having light-sensitivity over a whole wave length range, for example in a color light-sensitive material, light sources having high color rendition, i.e. those close to white such as those disclosed in Japanese Published Unexamined Patent Application Nos. 137350/1981 and 70223/1983 are preferable. Proper illuminance of light is 0.01 to 2,000 luxes, preferably 0.05 to 30 luxes, particularly 0.05 to 5 luxes. It is preferable that when the sensitivity of the emulsions used in the light-sensitive material is high, the illuminance of exposure is low. Adjustment of illuminance may be carried out by changing luminous intensity of the light source, by reducing light by various filters or by changing the distance between the light-sensitive material and the light source or the angle between the light-sensitive material and the light source. It is also possible to shorten the exposure time by using a weaker light at the early stage of the exposure and then using stronger light.

Light irradiation is preferably conducted after the light-sensitive material is soaked in a developing solution or a solution of a pre-bath thereof to make it fully permeate the emulsion layer of the light-sensitive material.

Time from the soak in the solution to the light fogging exposure is generally 2 seconds to 2 minutes, preferably 5 seconds to 1 minute, particularly 10 to 30 seconds.

Exposure time for fogging is generally 0.01 second to 2 minutes, preferably 0.1 seconds to 1 minute, particularly 1 to 40 seconds.

When the nucleating agent is contained in the light-sensitive material, its preferred amount to be used is $10^{-8}$ to $10^{-2}$ moles, especially $10^{-7}$ to $10^{-3}$ moles per 1 mole of silver halide.

Further, when the nucleating agent is added to the processing solution, its preferred amount to be used is $10^{-5}$ to $10^{-1}$ moles, especially $10^{-4}$ to $10^{-2}$ moles per 1 l of the processing solution.

Nucleating agents useful for the present invention are preferably compounds represented by the following general formula (N−1) or (N-II). The general formula (N−1)

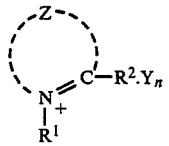

(wherein, Z represents nonmetal atoms necessary for forming a 5- or 6-membered heterocyclic ring and may contain a substituent; $R^1$ is an aliphatic group; $R^2$ is a hydrogen atom, an aliphatic group or an aryl group; $R^1$ and $R^2$ may contain a substituent, provided that at least one of $R^1$, $R^2$ and Z groups contain an alkynyl group, an acyl group, a hydrazine group or a hydrazone group, or $R^1$ and $R^2$ are combined together to form dihydropyridinium skeleton as a 6-membered ring; further, at least one of $R^1$, $R^2$ and Z may contain $X^1$-($L^1$)- wherein $X^1$ is a group for promoting adsorption on silver halide and $L^1$ is a bivalent linking group; Y is a counter ion for electrical charge balance; n is 0 or 1; and m is 0 or 1).

In more detailed explanation, the heterocyclic ring as completed by Z includes quinolinium, benzothiazolium, benzimidazolium, pyridinium, naphthopyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthoxazolium and benzoxazolium rings.

Substituents on Z include alkyl groups, alkenyl groups, aralkyl groups, aryl groups, alkynyl groups, hydroxy groups, alkoxy groups, aryloxy groups, halogen atoms, amino groups, alkylthio groups, arylthio groups, acyloxy groups, acylamino groups, sulfonyl groups, sulfonyloxy groups, sulfonylamino groups, carboxyl groups, acyl groups, carbamoyl groups, sulfamoyl groups, sulfo groups, cyano groups, ureido groups, urethane groups, carbonic acid ester groups, hydrazine groups, hydrazone groups or imino groups. As the substituent(s) on Z, at least one grouup is selected, for example from the above-mentioned substituents, and when two or more groups are selected, they may be the same or different. The above-mentioned substituents may further be substituted with there substituents.

Further, the substituent may have heterocyclic quaternary ammonium group as completed through an appropriate linking group L. In this occasion, so-called dimer structure is taken.

Preferred heterocyclic rings as completed by Z include quinolinium, benzothiazolium, benzimidazolium, pyridinium, naphthopyridinium, acridinium, phenanthridinium and isoquinolinium; particularly preferred ones are quinolinium, benzothiazolium and benzimidazolium, especially quinolinium and benzothiazolium. Best one is quinolinium.

Aliphatic group of $R^1$ and $R^2$ is a nonsubstituted alkyl group having 1–18 carbon atoms and a substituted alkyl group the alkyl of which has 1–18 carbon atoms. The substituents include those mentioned as the substituents on Z.

The aryl group represented by $R^2$ is those having 6–20 carbon atoms, for example a phenyl group, a naphthyl group, etc. The substituents include those mentioned as the substituents on Z. Among them, methyl and substituted methyl groups are preferred. Substituents on the methyl group are preferably an alkyl group, an alkenyl group and an aralkyl group.

At least one of the groups represented by $R^1$, $R^2$ and Z has an alkynyl group, an acyl group, a hydrazino group or a hydrazono group, or $R^1$ and $R^2$ combine to form a dihydropyridinium skeleton as a 6-membered ring. These groups may be substituted with the group mentioned as the substituents of the group represented as Z. As the hydrazine group, those having an acyl group or a sulfonyl group as a substituent are preferable.

As the hydrazone group, those having an aliphatic group or an aryl group as a substituent are preferable.

As the acyl group, a formyl group, and an aliphatic or aromatic ketone are preferred.

The alkynyl substituent on $R^1$, $R^2$ or Z preferably includes those having 2–18 carbon atoms, for example an ethynyl group, a propargyl group, a 2-butynyl group, a 1-methylpropargyl group, a 1,1-dimethylpropargyl group, a 3-butynyl group, a 4-pentynyl group, etc.

Further, these groups may be substituted with the group mentioned as substituents on Z. Specific examples include, 3-phenylpropargyl group, 3-methoxycarbonylpropargyl group, 4-methoxy-2-butynyl group and so on.

The compounds wherein at least one of the groups represented by $R^1$, $R^2$ and Z or the substituents on the ring is an alkynyl group or an acyl group, or the compounds wherein $R^1$ and $R^2$ are combined to form a dihydropyridinium skeleton are preferable, and the compounds wherein at least one alkynyl group is contained as the substituents of the groups or ring represented by $R^1$, $R^2$ and Z is most desirable.

Preferred examples of the adsorption-promoting groups are a thioamido group, a mercapto group, and a nitrogen-containing 5- or 6-membered heterocyclic group.

The thioamido adsorption-promoting group represented by $X^1$ is a bivalent group represented by

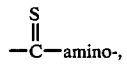

and may be a part of the ring structure or non-cyclic thioamido group. Useful thioamido adsorption-promoting group can be selected from those disclosed, for example, in U.S. Pat. No. 4,030,925, 4,031,127, 4,080,207, 4,245,037, 4,255,511, 4,266,013 and 4,276,364, and Research Disclosure 151, No. 15162 (November, 1976) and ibid. 176, No. 17626 (December, 1978).

Specific examples of the non-cyclic thioamido groups are a thioureido group, a thiourethane group, dithiocarbamic acid ester group, etc., and specific examples of the cyclic thioamido groups are 4-thiazoline-2-thione, 4-imidazoline-2-thione, 2-thiohydanthoin, rhodanine, thiobarbituric acid, tetrazoline-5-thione, 1,2,4-triazoline-3-thione, 1,3,4-thiadiazoline-5-thione, 1,3,4-oxadiazoline-2-thione, benzimidazoline-2-thione, benzoxazoline-2-thione, benzothiazoline-2-thione, etc. These groups may further be substituted.

The mercapto group of $X^1$ includes both the compounds in which a —SH group is directly bonded to the group represented by $R^1$, $R^2$ or Z and the compounds in which —SH group in bonded to a substituent on the group represented by $R^1$, $R^2$ or Z. After all, the mercapto group includes an aliphatic mercapto group, an aromatic mercapto group and a heterocyclic mercapto group (When the group adjacent to the carbon atom to which a —SH group is bonded is a nitrogen atom, the mercapto group has the same definition as the cyclic thioamido group which is in relation of a tautomer thereof, and examples of this group are the same as those enumerated above).

The nitrogen-containing 5- or 6-membered heterocyclic group includes nitrogen-containing 5- or 6-membered heterocyclic ring consisting of combination of nitrogen, oxygen, sulphur and carbon, preferably benzotriazole, triazole, tetrazole, indazole, benzimidazole, imidazole, benzothiazole, thiazole, benzoxazole, oxazole, thiadiazole, oxadiazole, triazine, etc. These groups may further be substituted with a proper substituent. Such substituent includes those enumerated as the substituents on Z. Preferred nitrogen-containing heterocyclic rings are benzotriazole, triazole, tetrazole and indazole, and benzotriazole is best.

The bivalent linking group represented by $L^1$ includes atoms or atomic groups containing at least one of C, N, S and O. Specifically, for example, an alkylene group, an alkenylene group, an alkynylene group, an arylene group, —O—, —S—, —NH—, —N=, —CO—, $—SO_2—$ (these groups may have a substituent), etc. alone or in combination thereof.

The counter ion Y for electrical charge balance is any negative ion which can countervail positive electrical charge of quaternary ammonium salt in the heterocyclic ring, and includes, for example, a bromide ion, a chloride ion, an iodide ion, a p-toluenesulfonate ion, an ethylsulfonate ion, a perchlorate ion, a trifluoromethanesulfonate ion, a thiocyanate ion, etc. In this case n is 1. When the heterocyclic quaternary ammonium salt contain a negatives ion substituent such as a sulfoalkyl substituent, the salt can take a form of a betaine, and in the occasion the counter ion is not necessary and n is 0. When the heterocyclic quaternary ammonium salt has two negative ion substituents, for example, two sulfoalkyl groups, Y is positive ionic counter ions and includes, for example, alkali metal ions (sodium ion, potassium ion, etc.), ammonium salts (triethylammonium, etc.) etc.

The following are specific examples of the compounds represented by the general formula (N-I), but the present invention is not limited thereto.

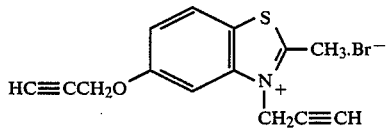

(1)

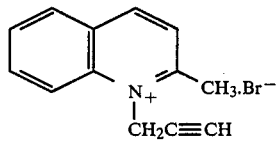

(2)

-continued
(3)
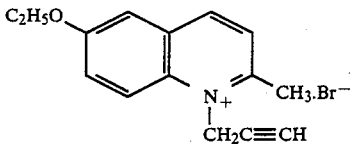
(4)
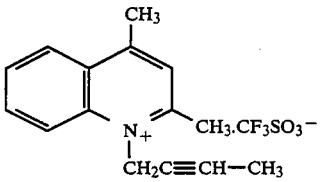
(5)
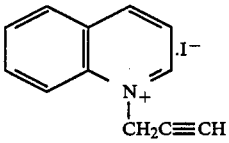
(6)
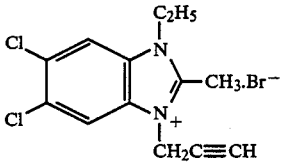
(7)
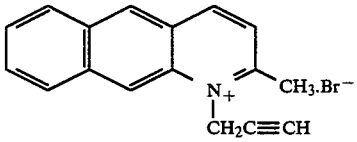
(8)
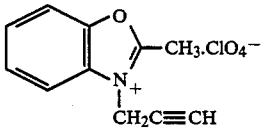
(9)
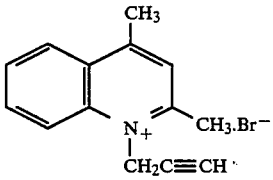
(10)
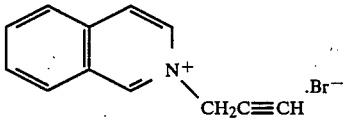
(11)
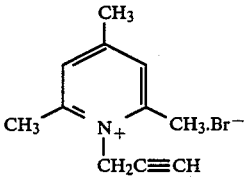
(12)
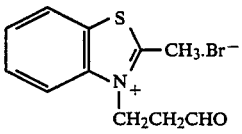

-continued
(13)
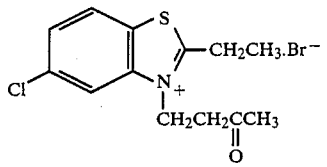
(14)
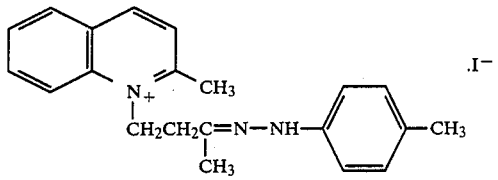
(15)
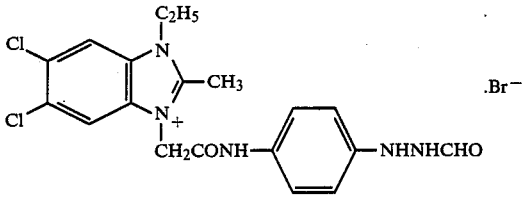
(16)
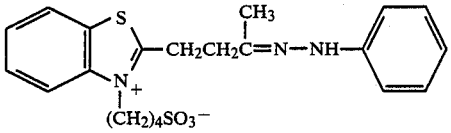
(17)
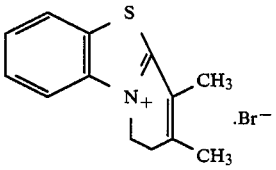
(18)
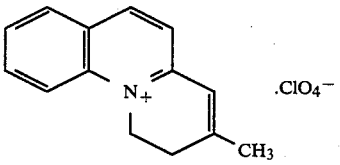
(19)
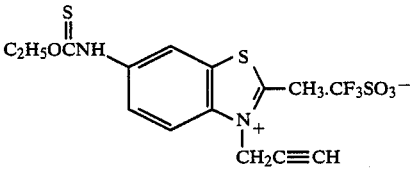
(20)
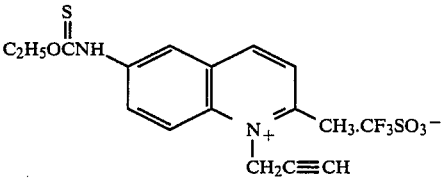

-continued
(21)
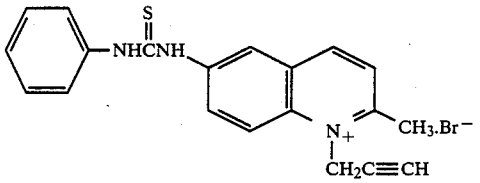
(22)
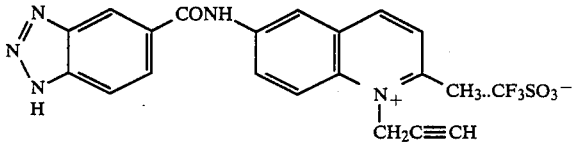
(23)
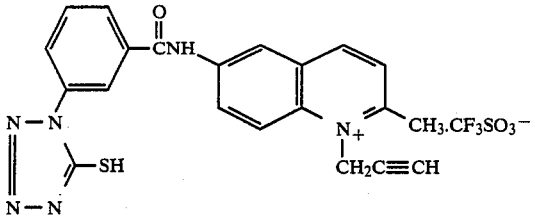
(24)
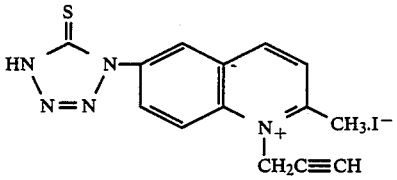
(25)
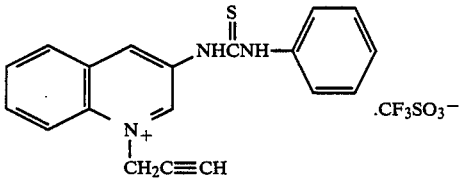
(26)
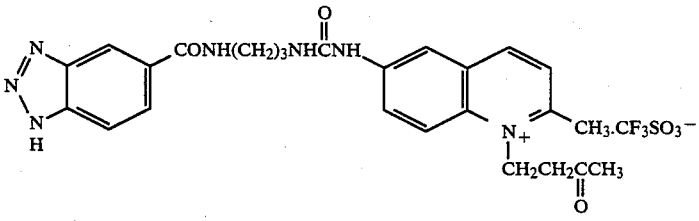
(27)
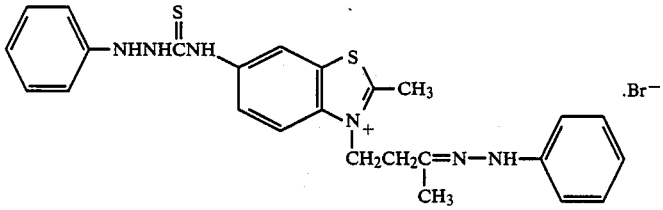
(28)
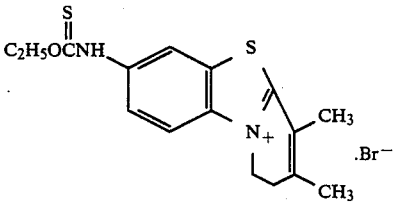

-continued
(29)
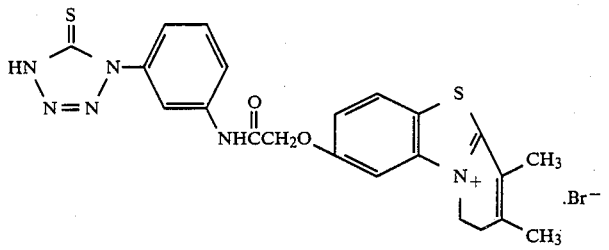
(30)
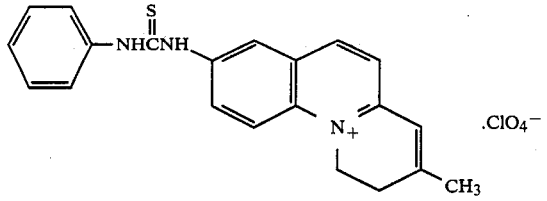
(31)
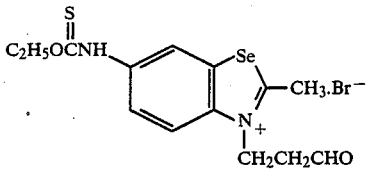
(32)
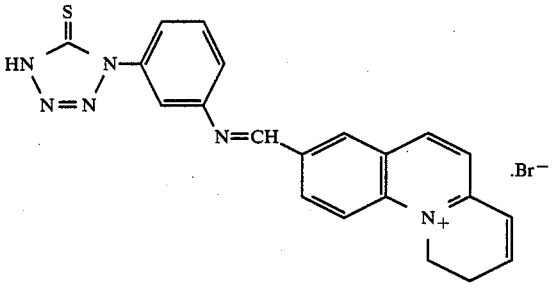
(33)
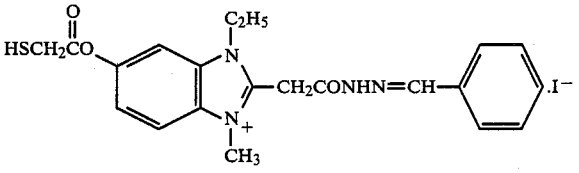
(34)
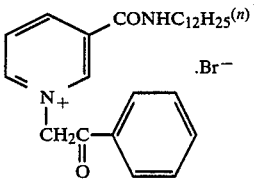
(35)
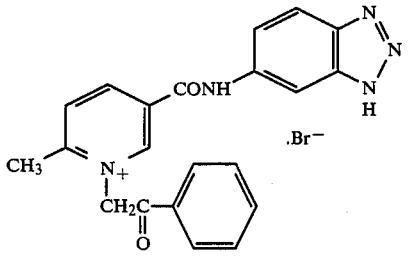
The above-mentioned compounds can be synthesized according to the processes disclosed, for example int he patent cited in Research Disclosure No. 22,534 published in January, 1983, pages 50 to 54, U.S. Pat. No.

4,471,044, etc. or according to the analogous process thereof.

The general formula (N-II)

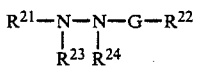

wherein, $R^{21}$ represents an aliphatic group, an aromatic group or a heterocyclic group; $R^{22}$ represents a hydrogen atom, an alkyl group, an aralkyl group, an aryl group, an alkoxy group, an aryloxy group or an amino group; G represents a carbonyl group, a sulfonyl group, a sulfoxy group, a phosphoryl group or an iminomethylene group

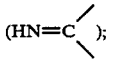

$R^{23}$ and $R^{24}$ are both hydrogen atoms, or one of them represents a hydrogen atom and the other represents any one of an alkylsulfonyl group, an arylsulfonyl group or an acyl group. In this connection, G, $R^{23}$, $R^{24}$ and hydrazine nitrogens may form together a hydrazone structure

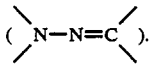

Further, the above-mentioned groups may be substituted with a substituent, if possible.

The aliphatic group represented by $R^{21}$ in the general formula (N-II) is a straight-chain, branched or cyclic alkyl group, alkenyl group or alkynyl group.

The aromatic group represented by $R^{21}$ includes monocyclic or bicyclic aryl groups, for example, a phenyl group, a naphthyl group, etc.

The heterocyclic rings of $R^{21}$ are 3- to 10-membered saturated or unsaturated heterocyclic rings containing at least one of N, O and S atoms, and may be monocycles or form condensed ring together with other aromatic rings or heterocyclic rings. Preferred heterocyclis rings include 5- or 6-membered aromatic heterocyclic groups, for example, a pyridyl group, a quinolinyl group, an imidazolyl group, a benzimidazolyl group, etc.

$R^{21}$ may have the following substituent which may further be substituted: an alkyl group, an aralkyl group, an alkoxy group, an alkyl or aryl group, a substituted amino group, an acylamino group, a sulfonylamino group, an ureido group, an urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a carboxyl group, etc. Among them, an ureido group is preferred.

These groups may be combined together to form a ring, if possible.

Preferred $R^{21}$ groups ae aromatic groups, aromatic heterocyclic rings or aryl-substituted methyl groups, and more desired one is aryl groups such as a phenyl group, a naphtyl group, etc.

Preferred groups of those represented $R^{22}$ are, in case of G being a carbonyl group, a hydrogen atom, an alkyl group (for example, a methyl group, a trifluoromethyl group, a 3-hydroxypropyl group, a 3-methansulfonamidopropyl group, etc.), an aralkyl group (for example, o-hydroxybenzyl group, etc.), an aryl group (for example, a phenyl group, a 3,5-dichlorophenyl group, an o-methanesulfonamidophenyl group, a 4-methanesulfonylphenyl group, etc.), etc., and a hydrogen atom is especially preferable.

When G is a sulfonyl group, preferred $R^{22}$ groups are an alkyl group (for example, a methyl group, etc.), an aralkyl group (for example, an o-hydroxyphenylmethyl group, etc.), an aryl group (for example, a phenyl group, etc.), a substituted amino group (for example, a dimethylamino group, etc.), etc.

As the substituent of $R^{22}$, the substituents enumerated in respect of $R^{21}$ can be used, and further, an acyl group, an acyloxy group, an alkyl or aryloxycarbonyl group, an alkenyl group, an alkynyl group, a nitro group, etc. can also be used.

These substituents may further be substituted with these substituents. Further, these groups may be combined together to form a ring, if possible.

It is preferable that $R^{21}$ or $R^{22}$, especially $R^{21}$ contains a diffusion-resistant group in couplers, that is so-called ballast group. The ballast group has 8 or more of carbon atoms and consists of combination of at least one of an alkyl group, a phenyl group, an ether group, an amido group, an ureido group, an urethane group, a sulfonamido group, a thioether group, etc.

$R^{21}$ or $R^{22}$ may have a group $X^2$—$(L^2)_{m2}$— for promoting adsorption of compounds represented by the general formula (N-II) onto the surface of silver chloride grains. In this connection, $X^2$ has the same meaning as that of $X^1$ in the general formula (N-I), and preferably, is a thioamido group (excluding unsubstituted and substituted thiosemicarbazido), a mercapto group, or a 5- or 6-membered nitrogen-containing heterocyclic group. $L^2$ represents a bivalent linking group and has the same meaning as that of $L^1$ in the general formula (N-I). $m^2$ is 0 or 1.

More desired $X^2$ groups are cyclic thioamido groups (that is, a mercapto-substituted nitrogen-containing heterocyclic ring, for example, a 2-mercaptothiadiazolyl group, a 3-mercapto-1,2,4-triazolyl group, a 5-mercaptotetrazolyl group, a 2-mercapto-1,3,4-oxadiazolyl group, a 2-mercaptobenzoxazolyl group, etc.), or nitrogen-containing heterocyclic groups (for example, a benzotriazole group, a benzimidazole group, a indazole group, etc.).

The particularly preferred $R^{23}$ and $R^{24}$ are a hydrogen atom, respectively. The most desired G in the general formula (N-II) is a carbonyl group.

More desired general formula (N-II) is those having an adsorption group onto silver halide. Especially preferred adsorption groups onto silver halide are a mercapto group, a cyclic thioamido group, an ureido group and a nitrogen-containing heterocyclic group, as hereinabove described in respect of the general formula (N-I).

Specific examples of the compounds represented by the general formula (N-II) are shown below. However, the present invention should not be limited to the following compounds.

(36)
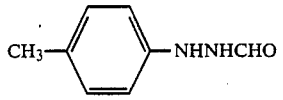
(37)
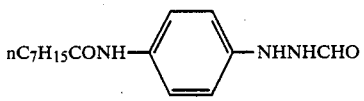
(38)
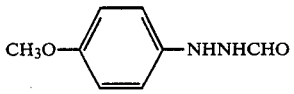
(39)
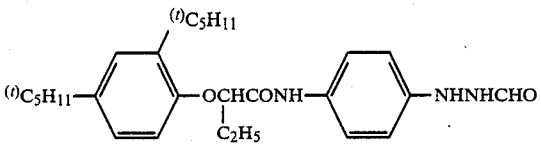
(40)
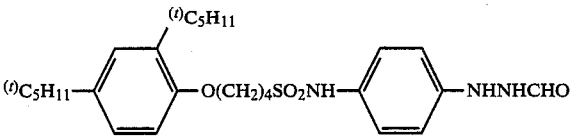
(41)
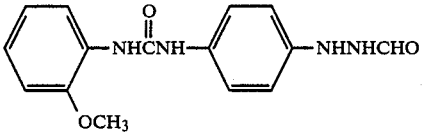
(42)
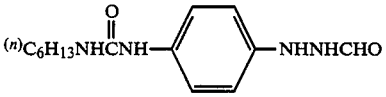
(43)
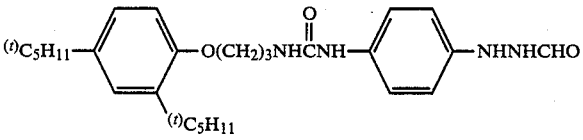
(44)
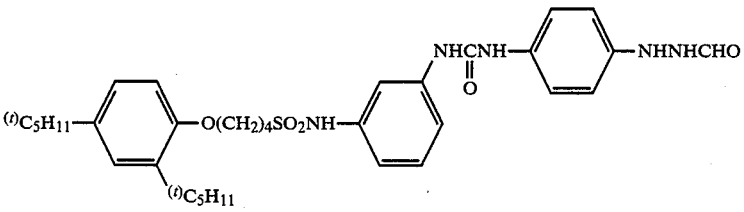
(45)
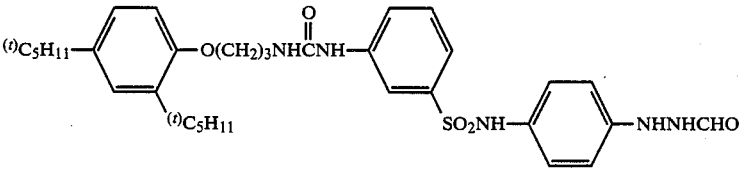
(46)
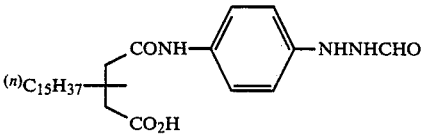

-continued
(47)
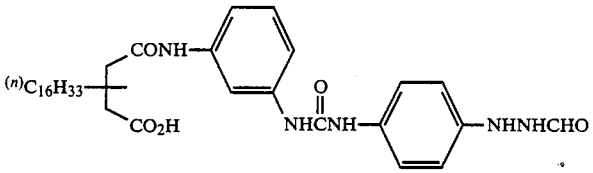
(48)
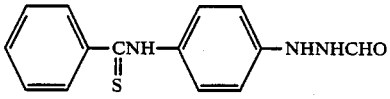
(49)
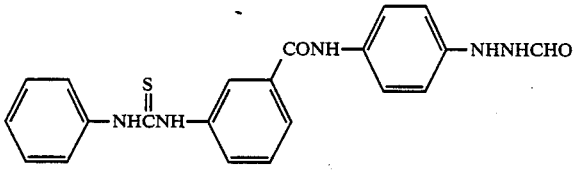
(50)
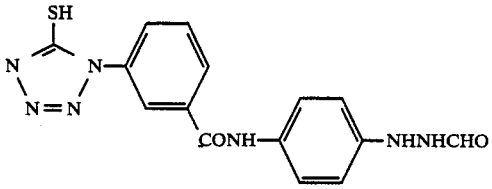
(51)
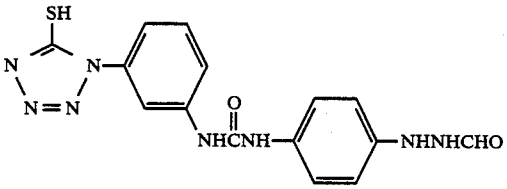
(52)
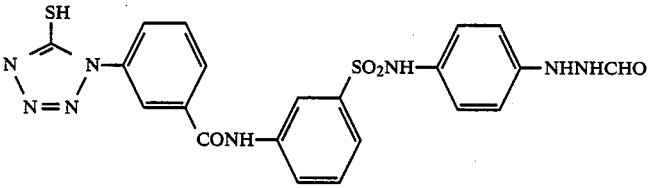
(53)
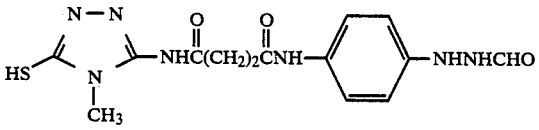
(54)
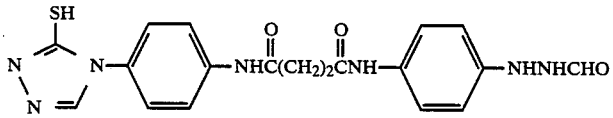
(55)
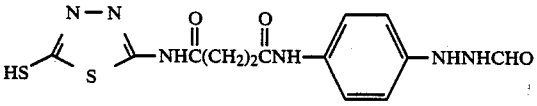
(56)
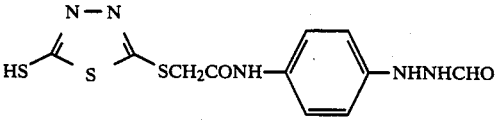

-continued
(57)
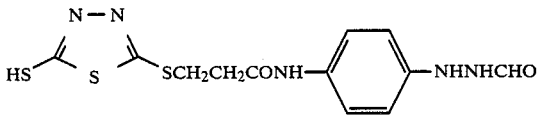
(58)
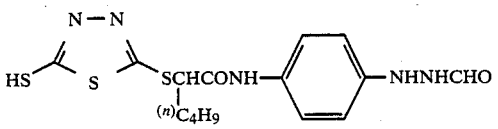
(59)
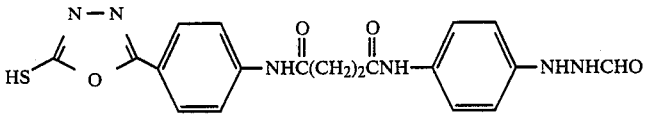
(60)
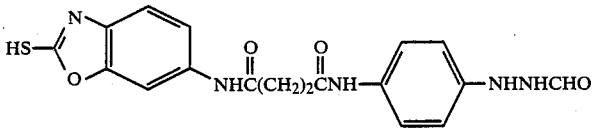
(61)
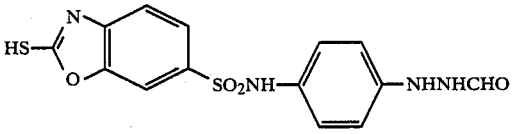
(62)
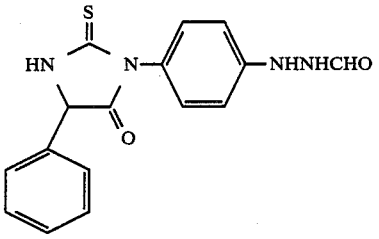
(63)
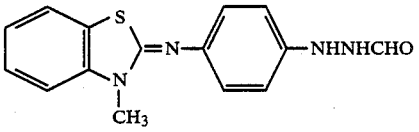
(64)
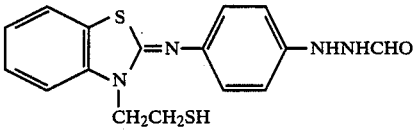
(65)
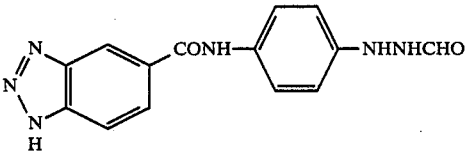
(66)
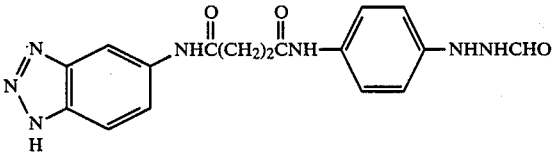

-continued
(67)
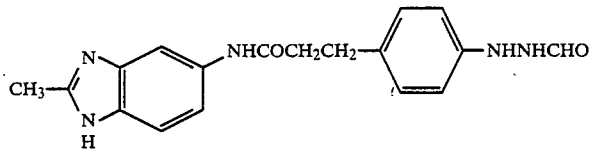
(68)
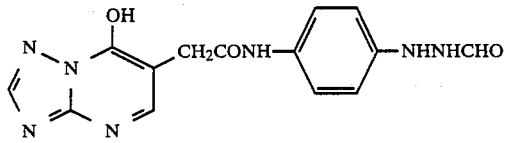
(69)
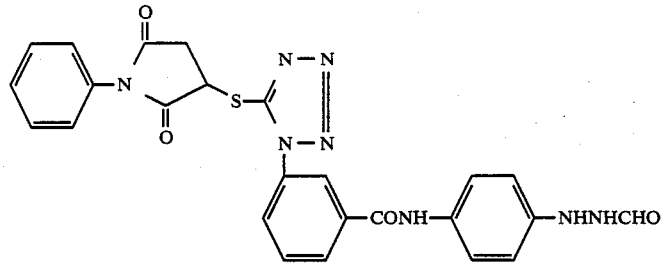
(70)
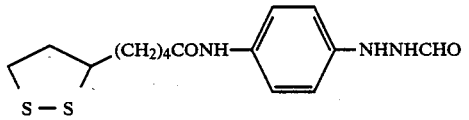
(71)
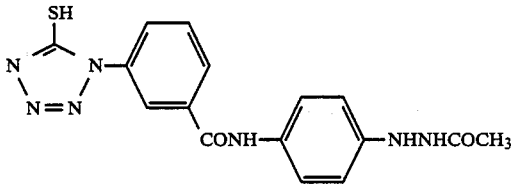
(72)
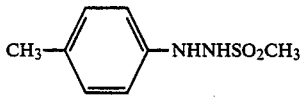
(73)
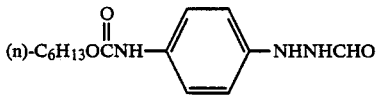
(74)
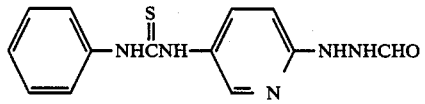
(n)-$C_{12}H_{25}$NHNHCHO (75)
(76)
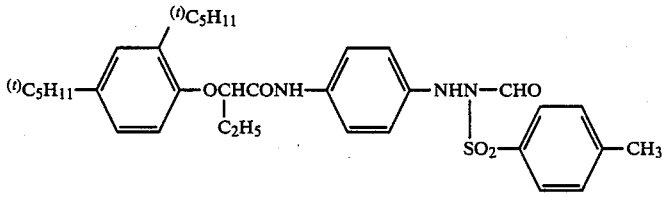
(77)
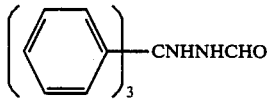

-continued

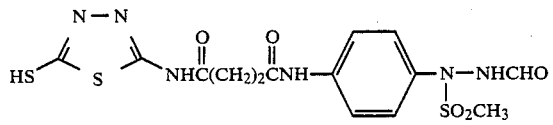

(78)

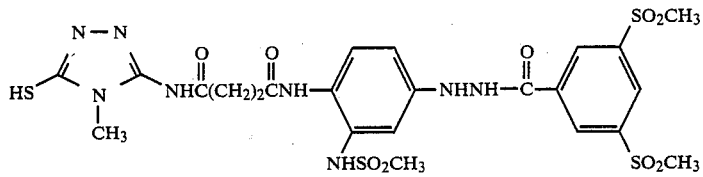

(79)

Synthesis of the compounds represented by the general formula (N-II) used in the present invention can be conducted according to processes described, for example, in the patents cited in Research Disclosure No. 15,162 (November, 1976, pages 76–77), ibid. No. 22,534 (January, 1983, pages 50–54) and ibid. No. 23,510 (November, 1983, pages 346–352); U.S. Pat. Nos. 4,080,207, 4,269,924, 4,276,364, 4,278,748, 4,385,108, 4,459,347, 4,478,928 and 4,560,638, U.K. Pat. No. 2,011,391 B and Japanese Published Unexamined Patent Application No. 179,734/1985, etc.

Fogging with light in the present invention can be conducted according to the processes described, for example in U.K. Pat. No. 1,151,363, Japanese Published Examined Patent Application Nos. 12710/1970, 12709/1970, and 6936/1983, Japanese Published Unexamined Patent Application Nos. 9727/1973, 137350/1981, 129438/1982, 62652/1983, 60739/1983, 70223/1983 (corresponding to U.S. Pat. No. 4,440,851) and 120248/1983 (corresponding to European Pat. No. 89101A2).

The following compounds can be used in combination with the nucleating agent for the purpose of raising maximum density, lowering minimum density, accelerating nucleation development, etc. These compounds are hydroquinones (for example, the compounds disclosed in U.S. Pat. Nos. 3,227,552 and 4,279,987); chromans (for example, the compounds disclosed in U.S. Pat. No. 4,268,621, Japanese Published Unexamined Patent Application No. 103031/1979 and Research Disclosure No. 18,264 (1979)); tetrazaindenes, pyrazoles, triazoles, benzotriazoles (for example, those disclosed in U.S. Pat. No. 4,572,892); thiadiazoles; pyridazines; triazines; triazolotriazoles; diazaindenes; triazaindenes; pentazaindenes; phthalazinones; indazoles; benzimidazoles; benzothiazoles; benzooctazoles (for example, the compounds disclosed in Japanese Published Unexamined Patent Application Nos. 94221/1978 and 170843/1985); quinones (for example, the compounds disclosed in Research Disclosure No. 21,206 (1981)); amines (for example, the compounds disclosed in U.S. Pat. No. 4,150,993 and Japanese Published Unexamined Patent Application No. 174757/1983); oxidizing agents (for example, the compounds disclosed in Japanese Published Unexamined Patent Application No. 260039/1985 and Research Disclosure No. 16,936 (1978)); catechols (for example, the compounds disclosed in Japanese Published Unexamined Patent Application Nos. 21013/1980 and 65944/1980); the compounds which release a nucleating agent upon development (for example, the compounds disclosed in Japanese Published Unexamined Patent Application No. 107029/1985); thioureas (for example, the compounds disclosed in Japanese Published Unexamined Patent Application No. 95533/1985); spirobis-indanes (for example, the compounds disclosed in Japanese Published Unexamined Patent Application No. 65944/1980); mercapto compounds (for example, U.S. Pat. No. 3,708,298 and Japanese Published Unexamined Patent Application No. 170843/1985); the nitrogen-containing heterocyclic compounds disclosed in Japanese Published Unexamined Patent Application No. 97091/1975 and Research Disclosure No. 15,162 (1976).

Various color forming couplers are used for forming direct positive color image. Useful color forming couplers are compounds which form or release substantially non-diffusible dyes by the coupling reaction with the oxidized products of p-phenylenediamine color developing agents and are themselves substantially non-diffusible. Typical examples of useful color forming couplers are naphthol or phenol compounds, pyrazolone or pyrazoloazole compounds, and open-chained or heterocyclic ketomethylene compounds. Specific examples of these cyan, magenta and yellow couplers used in the present invention are disclosed in the patents cited in Research Disclosure No. 17,643 (published in December, 1978) item VII-D and ibid. No. 18,717 (published in November, 1979).

Typical yellow couplers preferably used in the present invention are 2-equivalent yellow couplers of oxygen atom coupling-off type or nitrogen atom coupling-off type. Above all, α-pivaloylacetanilide couplers are excellent in fastness, especially light fastness of formed dyes, and α-benzoylacetanilide couplers give high color density, and therefore these are preferable.

5-Pyrazolone magenta couplers preferably used in the present invention are 5-pyrazolone couplers having at the 3-position an arylamino group or an acylamino group (especially, 2-equivalent couplers of sulfur atom coupling-off type).

Particularly preferred are pyrazoloazole couplers, especially pyrazolo (5,1-C) (1,2,4) triazoles, and from the point of a low yellow stain and light fastness, imdazo (1,2-b) pyrazoles disclosed in U.S. Pat. No. 4,500,630 are further desirable and pyrazolo (1,5-b) (1,2,4) triazoles as disclosed in U.S. Pat. No. 4,540,654 are especially preferable.

Cyan couplers used in the present invention are naphthol and phenol couplers disclosed in U.S. Pat. Nos. 2,474,293 and 4,052,212, and phenol cyan couplers having an alkyl group having two or more carbon atoms at meta-position of the phenol skeleton as disclosed in U.S. Pat. No. 3,772,002; and moreover, 2,5-diacylamino-substituted phenol couplers are also preferably used from the point of fastness of the dye image.

Colored couplers for correcting unwanted absorption of the dyes formed in short wave length region: couplers that form dyes having appropriate diffusibility; colorless couplers, DIR couplers releasing a development-restraining agent upon coupling reaction, couplers releasing a development-promoting agent upon coupling reaction, polymerized couplers can also be used.

Typical amount of the color couplers used is in the range of 0.001 to 1 moles per mole of light-sensitive silver halide, preferably 0.01 to 0.5 moles for yellow couplers, 0.003 to 0.3 moles for magenta couplers and 0.002 to 0.3 moles for cyan couplers.

These couplers dissolved in an organic solvent of high- and/or low-boiling point are emulsified and dispersed into an aqueous solution of gelatin or other hydrophilic colloid with vigorous agitation using a homogenizer, by mechanical pulverization with a colloid mill, or by an ultrasonic wave, and then are incorporated into emulsion layers. In this case, it is preferred to use the compounds disclosed in pages 440–467 of the specification of Japanese Patent Application No. 32462/1986, although it is not always necessary to use a high-boiling solvent.

These couplers can also be dispersed into a hydrophilic colloid by the method disclosed in pages 468–475 of the specification of Japanese Patent Application No. 32462/1986.

Further, a color enhancing agent can be used so as to improve coloring property of couplers. Typical examples of such a color enhancing agent are disclosed in pages 374–391 of the specification of Japanese Patent Application No. 32462/1986.

Light-sensitive materials used in the present invention may contain, as an anticolorfoggant or a color mixing inhibitor, huydroquinone derivatives, aminophenol derivatives, amines, gallic acid derivatives, catechol derivatives, ascorbic acid derivatives, colorless compound forming couplers, sulfonamidophenol derivatives, etc.

Light-sensitive materials used in the present invention may also contain various decoloration-preventing agents. Typical organic decoloration-preventing agents include hydroquinones, 6-hydroxychromans, 5-hydroxycoumaranes, spirochromans, p-alkoxyphenols, hindered phenols such as mainly bisphenols, gallic acid derivatives, methylenedioxybenzenes, aminophenols, hindered amines, and ether or ester derivatives of these compounds obtained by silylation or alkylation of a phenolic hydroxl group of them. Further, metal complexes represented by a (bissalicylaldoxymato) nickel complex and a (bis-N,N-dialkyldithiocarbamato) nickel complex may also be used.

Compounds having both partial structures of hindered amine and hindered phenol such as those disclosed in U.S. Pat. No. 4,268,593 give good results for prevention of deterioration of yellow dye images by heat, humidity and light. Further, for prevention of deterioration, especially deterioration by light of magenta dye images, spiroindanes disclosed in Japanese Published Unexamined Patent Application No. 159644/1981 and chromans substituted with hydroquinone diether or monoether give preferred results. These compounds are emulsified together with color couplers respectively corresponding thereto usually in an amount of 5 to 100 wt.% based on the couplers, and added to the light-sensitive layers, whereby the desired purpose can be attained. For prevention of deterioration of cyan dye images by heat and light, especially by light, it is effective to introduce a UV absorbant in the layers of both sides adjacent to cyan color forming layer. Further, the UV absorbant can also be added to a hydrophilic colloidal layer such as a protective layer.

Advantageous bonding agent or protective colloid as can be used in an emulsion layer or an intermediate layer of light-sensitive materials of the present invention is gellatin, but other hydrophilic colloid can also be used.

Light-sensitive materials of the present invention may contain dyes for prevention of irradiation or halation, plasticizers, fluorescent whiteners, matting agents, aerial fogging-preventing agent, coating aids, hardening agents, antistatic agents, sliding property-improving agents, etc. Typical examples of these agents are disclosed in Research Disclosure No. 17,643 (published in December, 1978) and ibid. 18716 (published in November, 1979).

The present invention can be applied to multi-layered multi-color photographic materials having at least two different spectral sensitivity on a substrate. Multi-layered color photographic materials generally have at least one of each layers of red-sensitive emulsion layers, green-sensitive emulsion layers and blue-sensitive emulsion layers, on a substrate. The order of these layers can be determined freely according to the necessity. Preferred order of the layer arrangement is red-sensitive, green-sensitive and blue-sensitive from the support side, or blue-sensitive, red-sensitive and green-sensitive from the support side. The afore-mentioned each emulsion layer may consists of two or more different emulsion layers, or a non-light-sensitive layer may exist between two or more emulsion layers having the same sensitivity. Usually, cyan-forming couplers, magenta-forming couplers and yellow-forming couplers are respectively introduced in the red-sensitive emulsion layer, green-sensitive emulsion layer and blue-sensitive emulsion layer, but other combination is possible, if necessary.

Light-sensitive materials of the present invention are preferable to have in addition to the silver halide emulsion layers an auxiliary layer such as a protective layer, an intermediate layer, a filter layer, an antihalation layer, a back layer, a white-reflecting layer, etc. according to the necessity.

In photographic light-sensitive materials of the present invention, photographic emulsion layer and the other layers are coated on a flexible support such as plastic films, papers, cloths, etc. as usually used in photographic light-sensitive materials, or on a rigid substrate such as glasses, chinas, metals, etc. Useful flexible support include films consisting of semi-synthetic or synthetic polymers such as cellulose nitrate, cellulose acetate, cellulose acetate butyrate, polystyrene, polyvinyl chloride, polyethylene terephthalate, polycarbonate, etc.; baryta layers; or papers wherein an α-olefin polymer (such as polyethylene, polypropylene, a copolymer of ethylene/butane), etc. is coated or laminated thereon. The support may be colored with a dye or pigment. The substrate may be bleackened for the purpose of light-shielding. The surface of these support is in general undercoated for improving adhesiveness with the photographic emulsion layers, etc. The support surface may be treated by glow discharge, corona discharge, UV irradiation, flame treatment, etc. before or after the undercoating.

Coating of the silver halide photographic emulsion layers and the other hydrophilic colloidal layers can be conducted according to various known method such as a dip coating method, a roller coating method, a curtain coating method, an extrusion coating method, etc.

The present invention is applicable to various color light-sensitive materials, typically for example, color reversal films and color reversal papers for slides or televisions, etc. The present invention can also be applied to color hard copy for preserving images of full color copying machines or CRT. The present invention can also be applied to black-and-white light-sensitive materials which are utilizing mixing of couplers of three colors and disclosed in Research Disclosure No. 17123 (published in July, 1978) and the like.

The present invention can also be applied to black-and-white light-sensitive materials utilizing silver images. Such black-and-white light-sensitive materials include photographic light-sensitive materials for black-and-white direct positives, for example, X-ray light-sensitive materials, duplicate light-sensitive materials, micro light-sensitive materials, light-sensitive materials for photocomposition, printing light-sensitive materials, etc. as disclosed in Japanese Published Unexamined Patent Application Nos. 208540/1984 and 260039/1985.

Various known developing agents are usable for development of light-sensitive materials of the present invention. That is, polyhydroxybenzenes such as hydroquinone, 2-chlorohydroquinone, 2-methylhydroquinone, catechol, pyrogallol, etc.; aminophenols such as p-aminophenol, N-methyl-p-aminophenol, 2,4-diaminophenol, etc.; 3-pyrazolidone such as 1-phenyl-3-pyrazolidone, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone, etc.; ascorbic acid, and so on are usable alone or in combination. Developing solution as disclosed in Japanese Published Unexamined Patent Application No. 55939/1983 can also be used. The proper pH of the developing solution is 9 to 13, preferably 10 to 11.5.

The color developing solution used in the present invention for developing process of light-sensitive materials is a so-called surface developer, which does not substantially contain a solvent for silver halide, and is preferably an aqueous alkaline solution containing an aromatic primary amine color developing agent as a main component. The phrase "not substantially contain a solvent for silver halide" means that the surface developer may contain a small amount of a solvent for silver halide so long as it does not spoil the purpose of the invention.

Though aminophenol compounds are usable as the color developing agent, p-phenylenediamine compounds are preferably used therefor and as the typical examples thereof, 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfate, hydrochloride, phosphate, p-toluensulfonate, tetraphenylborate, p-(t-octyl)-benzenesulfonic acid, etc. of these compounds, etc. are mentioned. These diamines are more stable in a salt state than in a free state in general. The color developing agent is generally used in a concentration of about 0.1 g to about 30 g, generally about 1 g to about 15 g per 1 l of the color developing solution. Further, the color developing solution is used usually at a pH of 7 or more, most generally at a pH of about 9 to about 13. Preferably, the pH range is 11.5 or less, especially 11.0 or less. Further, with respect to the color developing solution, it is also possible to decrease the amount of a replenisher by using an auxiliary solution wherein the concentration of halides, a color developing agent, etc. is adjusted.

The color developing agent may contain a particular antifoggant and a developing restrainer. Alternatively, these additive agents for a developing solution may optionally be introduced in the construction layers of the photographic light-sensitive material. Useful antifoggants include heterocyclic compounds such as tetrazaindenes, benzindazoles, benzotriazoles, benzimidazoles, benzothiazoles, benzoxazoles and 1-phenyl-5-mercaptotetrazoles; aromatic and aliphatic mercapto compounds, etc. Some of these additive agents not only restrain fog, but also promote the development to increase the maximum image concentration ($D_{max}$).

Color developing process of the present invention is usually carried out for a time of 5 minutes or less, preferably for a time of 2 minutes and 30 seconds or less for promotion of the process. Preferred processing time is 30 seocnds–2 minutes. Generally, it is better that the color developing is carried out in a shorter time so long as the adequate color density is obtained.

From the viewpoint of prevention of pollution, ease of preparing the color developing solution, and improvement of preservation and stability of the solution, it is preferred that the color developing solution used in the present invention does not contain benzyl alcohol substantially. In this connection, the phrase "does not contain benzyl alcohol substantially" means that a benzyl alcohol is contained in a concentration of 2 ml/l or less, preferably 0.5 ml/l or less, and particularly is not contained at all.

The silver halide light-sensitive material of the present invention may contain color developing agents or precursors thereof in view of simplication and rapidity of the process. In this connection, the precursors are preferred in view of increase of stability of the light-sensitive material. Specific examples of such developing agent precursors are indoaniline compounds, Schiff base-type compounds, aldol compounds, urethane compounds, etc.

The silver halide color light-sensitive materials of the present invention may contain various 1-phenyl-3-pyrazolidones for promotion of color development.

The color developing solution of the present invention may contain a pH buffer, preservatives, or metal chelate compound disclosed in pages 14 to 22 of the specification of Japanese Patent Application No. 23462/1986. Further, a halide ion such as a bromide ion, an iodide ion, etc. and competing couplers such as citrazinic acid may be contained therein.

The photographic emulsion layers after the color development are usually subjected to bleaching treatment. The bleaching treatment can be carried out by simple bath bleach-fixing (blix) where bleaching and fixing are simultaneously carried out, or by two bath (bleaching and fixing) treatment. In view of rapidity of the treatment, either a method where the bleach-fixing treatment is conducted after the bleaching treatment, or a method where the bleach-fixing treatment is conducted after the fixing treatment can also be adopted.

As the bleaching agents used for the bleaching treatment or bleach-fixing treatment, organic complex salts of iron and persulfate are preferable in view of rapid treatment and environmental pollution.

As the organic complex salts of iron (III), iron (III) complex salts of ethylenediaminetetraacetic acid, diethylenetriaminepentaacetic acid, cyclohexanediaminetetraacetic acid, 1,2-diaminopropanetetraacetic acid, methyliminodiacetic acid, 1,3-diaminopropanetetraacetic acid, glycoletherdiaminetetraacetic acid are preferable as they have high bleaching abilities.

Preferred persulfates include alkali metal persulfates such as potassium persulfate, sodium persulfate, etc.; ammonium persulfate and the like.

The amount of the bleaching agent used per 1 of the bleaching solution is properly 0.1 to 2 moles. Preferred pH range of the bleaching solution is 0.5 to 8.0 in case of ferric ion complex salts, especially 4.0 to 7.0 in case of ferric ion complex salts of aminopolycarboxylic acids, aminopolyphosphonic acids, phosphonocarboxylic acids and organic phosphonic acids. When persulfate salts are used, the concentration of 0.1 to 2 moles/l and the pH rane of 1 to 5 are preferable.

Fixing agents used for the fixing or bleach-fixing are known fixing agents, and include water-soluble silver halide-dissolving agents, for example thiosulfate such as sodium thiosulfate and ammonium thiosulfate; thiocyanate such as sodium thiocyanate and ammonium thiocyanate; thioether compounds such as ethylenebisthioglycolic acid and 3,6-dithia-1,8-octanediol; thioureas and the like. These fixing agents can be used alone or in combination.

In case of the fixing treatment or bleach-fixing treatment, fixing agent is preferably used in a concentration of 0.2 to 4 moles/l. In case of the bleach-fixing treatment, preferably ferric ion complex salt and fixing agent are used in a concentration of 0.1 to 2 moles and 0.2 to 4 moles per 1 l of the bleach-fixing solution, respectively. The preferred pH range of the fixing a bleach-fixing solution is usually 4.0 to 9.0, especially 5.0 to 8.0.

The fixing solution or bleach-fixing solution may contain, in addition to the aforesaid additive agents as can be added to the bleaching solution, preservatives such as sulfites (e.g., sodium sulfite, potassium sulfite, ammonium sulfite), bisulfites, hydroxylamine, hydrazine, bisulfite addition aldehyde compounds (e.g., acetaldehyde sodium bisulfite), etc. Further, various fluorescent whiteners, defoaming agents, surfactants and organic solvents such as polyvinylpyrrolidone and methanol may be contained therein.

Bleach accelerators can be used, if necessary, in the bleaching solution, bleach-fixing solution and pre-baths of them. Specific examples of the useful bleach accelerators are compounds having a mercapto group or a disulfido group, thiazolidine derivatives, thiourea derivatives, iodide, polyethylene oxides, polyamines, etc. Further, the compounds disclosed in Japanese Published Unexamined Patent Application Nos. 42434/1974, 59644/1974, 94927/1978, 35727/1979, 26506/1980 and 163940/1983 and iodide and bromide ions may also be used therefor. Above all, the compounds having a mercapto group or disulfido group are preferably in view of strong accelerating effect, and especially the compounds as disclosed in U.S. Pat. No. 3,893,858, West Germany Pat. No. 1,290,812 and Japanese Published Unexamined Patent Application No. 95630/1978 are preferable. Further, the compounds disclosed in U.S. Pat. No. 4,552,834 are also preferable. These bleach accelerators may be added to the light-sensitive material.

Processing steps such as water washing and stabilizing process are generally carried out after the fixing step or bleach-fixing step.

In the water washing step or stabilizing step, various known compounds may be used for prevention of precipitation and stabilization of washing water. For exmaple, inorganic phosphoric acid; chelating agents such as aminopolycarboxylic acids and organic phosphonic acids; bacteriocides or antimold agents (for example, the compounds disclosed in J. Antibact. Antifung, Agents vol. 11, No. 5, p 207–223 (1983) and the compounds disclosed in "Boukin Boubai no Kagaku" (Chemistry for antibacterial and antifungal purpose) written by Hiroshi Horiguchi); metal salts represented by magnesium salts, alminum salts and bismuth salts; alkali metal salts; ammonium salts, surfactants for preventing load for dying and unevenness; etc. may be added, if necessary. The compounds disclosed "Phot. Sci. Eng." written by L. E. West, vol. 6, pages 344–359 (1965), etc. may also be added. Addition of a chelating agent, a bacteriocide or an antimold is especially effective.

The water washing process is usually carried out in a multi-step counterflow manner consisting of 2 or more baths (e.g. 2 to 9 baths) to save the amount of washing water. Otherwise, multi-step counterflow stabilization process as disclosed in Japanese Published Unexamined Patent Application No. 8543/1982 may be carried out instead of the water washing process. In the stabilizing bath, various compounds other than the aforesaid additives are added for the purpose of stabilizing the image. For instance, various buffers for adjusting the pH of the membrane (e.g., to pH 3 to 9) such as borates, metaborates, borax, phosphates, carbonates, potassium hydroxide, sodium hydroxide, aqueous ammonia, monocarboxylic acids, dicarboxylic acids and polycarboxylic acids in combination, and aldehydes such as formalin are mentioned as typical examples. In addition, various additives such as chelating agents (e.g., inorganic phosphoric acid, aminopolycarboxylic acids, organic phosphonic acids, aminopolyphosphonic acids and hosphonocarboxylic acid), bacteriocides, antimolds (e.g., thiazoles, isothiazoles, halogenated phenols, sulfanylamide and benzotriazole), surfactants, fluorescent whiteners and hardening metal salts may also be used. Two or more of these compounds for the same or different purpose may be used in combination.

Further, addition of various ammonium salts such as ammonium chloride, ammonium nitrate, ammonium sulfate, ammonium phosphate, ammonium sulfite and ammonium thiosulfate as a pH adjusting agent after the processing is preferred for improving preservability of the image.

The period of time of the water washing and the stabilization according to the present invention depend upon a type of light-sensitive materials to be processed and process conditions, and is usually 20 seconds to 10 minutes, preferably 20 seconds to 5 minutes.

Each of the process solutions is used at a temperature of from 10° to 50° C., typically from 33° to 38° C. However, a higher temperature may be used to facilitate the process and to shorten the time period of the process. In contrast, a lower temperature may also be used to improve the quality of the image and the stability of the processing solution.

Further, if necessary, each of the time periods of the processes may be shortened for quickening the processing in a range where no serious disadvantage takes place.

In case of a continuous process, a replenisher of each processing solution is used to prevent changes in the composition of the solution, whereby constant finished properties are obtained.

Each treatment bath may be provided with a heater, temperature sensor, level sensor, circulation pump, filter, various floating covers, and various squeezees.

EXAMPLES

Preparation of emulsions

Emulsion A

First, 30 g of gelatin was dissolved in 1 l of a mixture of 0.5 moles/l KBr, 0.2 moles/l NaCl and 0.0015 moles/l KI, and then, 700 cc of 1 mole/l silver nitrate was added thereto at 60° C. over a period of 20 minutes, and physical ripening was conducted for additional 20 minutes. Water-soluble halide was removed by water washing, 20 g of gelatin was added thereto, and then water was added thereto to make a total volume to 1200 cc to obtain an emulsion having an average grain size of 0.4 μm. 500 cc of 1 mole/l aqueous silver nitrate solution and 500 cc of 2 moles/l aqueous sodium chloride solution were simultaneously added to 300 cc of the emulsion to precipitate silver chloride shells, and the precipitate was washed with water to obtain the emulsion A having an average grain size of 0.7 μm.

Emulsion B

An aqueous potassium bromide solution and an aqueous silver nitrate solution were simultaneously added to an aqueous gelatin solution containing 3,4-dimethyl-1,3-thiazoline-2-thione in an amount of 0.3 g per 1 mole of silver with vigorous stirring at 75° C. over a period of about 20 minutes to obtain a silver bromide emulsion containing monodispersed octahedral silver bromide grains having an average grain size of 0.4 μm. There were added to the emulsion sodium thiosulfate and chloroauric acid tetrahydrate in an amount of 6 mg per 1 mole of silver, and the mixture was held at 75° C. for 80 minutes to carry out chemical sensitization process. The thus obtained silver bromide grains were used as core and processed for 40 minutes in the same precipitation environment as in the first process to grow, and finally to obtain a silver bromide emulsion containing monodispersed octahedral core/shell silver bromide grains having an average grain size of 0.7 μm (coefficient of variation 13%). After the emulsion was washed with water and desalted, there were added sodium thiosulfate and chloroauric acid tetrahydrate in a respective amount of 1.5 mg per 1 mole of silver. The mixture was held at 60° C. for 60 minutes to carry out chemical sensitization process to obtain an internal latent image type silver halide emulsion B.

Example 1

A color photographic light-sensitive material having the layer compositions shown in Table 1 was prepared on a paper support, both surfaces of which is laminated with polyethylene. The coating solutions were prepared as follows.

Preparation of the first layer coating solution:

First, 10 ml of ethyl acetate and 4 ml of a solvent (g) were added to 10 g of a magenta coupler (e) and 6.5 g of a dye image-stabilizing agent (f) to make a solution. The solution was emulsified and dispersed in 90 ml of 10% aqueous gelatin solution containing 5 ml of 10% sodium dodecylbenzenesulfonate. On the other hand, a green-sensitive dye (shown below) in an amount of $2.0\times10^{-4}$ moles per 1 mole of silver was added to the above-mentioned emulsion A to prepare 90 g of a green-sensitive emulsion. The emulsion-dispersion liquid and the emulsion were mixed to make a solution, gelatin was added thereto to adjust the concentration so as to make the composition shown in Table 1, and further, a nucleating agent was added thereto to prepare the coating solution for the first layer.

The coating solutions for the second and third layers were prepared in the same manner as in the first layer coating solution. Sodium salt of 1-oxy-3,5-dichloro-s-triazine was used as a gelatin-hardening agent in each layer.

TABLE 1

| Layer | Main component | Amount used |
|---|---|---|
| The 3rd layer (Protective layer) | Gelatin | 1.33 g/m$^2$ |
| | Acryl-modified polyvinyl alcohol copolymer (Modification degree 17%) | 0.17 g/m$^2$ |
| The 2nd layer (UV absorption layer) | Gelatin | 1.60 g/m$^2$ |
| | Colloidal silver | 0.10 g/m$^2$ |
| | UV absorbant (h) | $1.70\times10^{-4}$ moles/m$^2$ |
| | Color mixing inhibitor (i) | $1.60\times10^{-4}$ moles/m$^2$ |
| | Solvent (j) | 0.24 g/m$^2$ |
| The 1st layer (Green-sensitive layer) | Emulsion A (silver:) | 0.17 g/m$^2$ |
| | Gelatin | 1.56 g/m$^2$ |
| | Magenta coupler (e) | $3.38\times10^{-4}$ moles/m$^2$ |
| | Color image-stabilizing agent (f) | 0.19 g/m$^2$ |
| | Solvent (g) | 0.59 g/m$^2$ |
| | Nucleating agent (n) (shown in Table 3) | |
| Support | Polyethylene-laminated paper (A white pigment ($TiO_2$, etc.) and a bluish dye (ultramarine, etc.) are contained in the polyethylene of the 1st layer.) | |

The thus prepared direct position type silver halide color photographic light-sensitive material Nos. 1 to 15 were subjected to imagewise exposure through an optical wedge at 250 CMS for 1/10 seconds, and development was conducted according to eitehr Process step A or Process step B. In the process, light of 0.5 luxes (color temperature 5400 K.) was continuously irradiated on each of the light-sensitive materials for 10 seconds from 15 seconds after the development initiation. The process step was as follows.

| | Process step | | |
|---|---|---|---|
| | Time (minutes) | Temperature | Amount of replenisher |
| Color development | | | |
| A: | 2.5 | 33° C. | 350 ml/m$^2$ |
| B: | 3.5 | | |
| Bleach fixing | 1.5 | 33° C. | 100 ml/m$^2$ |
| Stabilization (1) | 1 | 33° C. | — |
| Stabilization (2) | 1 | 33° C. | — |
| Stabilization (3) | 1 | 33° C. | 200 ml/m$^2$ |

Stabilizing was carried out according to a so-called counterflow replenishment method in which the replenisher was first introduced to the stabilizing bath (3), the overflowed solution from the stabilizing bath (3) was introduced to the stabilizing bath (2), and the overflowed solution from the stabilizing bath (2) was introduced to the stabilizing bath (1).

| | Color developing solution | |
|---|---|---|
| | Mother liquor | Replenisher |
| Diethylenetriaminepentaacetic acid | 2.0 g | 2.0 g |
| Benzyl alcohol | 12.8 g | 14.0 g |

-continued

| Color developing solution | Mother liquor | Replenisher |
|---|---|---|
| Diethylene glycol | 3.4 g | 4.0 g |
| Sodium sulfite | 2.0 g | 2.0 g |
| Sodium bromide | 0.26 g | 0.26 g |
| Hydroxylamine sulfate | 2.60 g | 3.3 g |
| Sodium chloride | 3.20 g | — |
| 3-Methyl-4-amino-N—ethyl-N—(β-methanesulfonamidoethyl)-aniline | 4.25 g | 6.25 g |
| Potassium carbonate | 30.0 g | 25.0 g |
| Fluorescent whitener (Stilbene type) | 1.0 g | 1.5 g |
| Water to | 1000 ml | 1000 ml |
| pH | 10.20 | 10.40 |

The pH was adjusted with potassium hydroxide or hydrochloric acid.

| (Bleach-fixing solution) | Mother liquor | Replenisher |
|---|---|---|
| Ammonium thiosulfate | 110 g | Same as mother liquor |
| Sodium bisulfite | 10 g | |
| Ferric ammonium diethylene triaminepentaacetate monohydrate | 56 g | |
| Disodium ethylenediaminetetraacetate dihydrate | 5 g | |
| 2-Amino-5-mercapto-1,3,4-thiadiazole | $5 \times 10^{-3}$ mol | |
| Water to | 1000 ml | |
| pH | 6.5 | |

The pH was adjusted with aqueous ammonia or hydrochloric acid.

| (Stabilizing solution) | Mother liquor | Replenisher |
|---|---|---|
| 1-Hydroxyethylidene-1,1'-diphosphonic acid (60%) | 1.6 g | Same as mother liquor |
| Bismuth chloride | 0.35 g | |
| Polyvinylpyrolidone | 0.25 g | |
| Aqueous ammonia | 2.5 ml | |
| Trisodium nitrilotriacetate | 1.0 g | |
| 5-Chloro-2-methyl-4-isothiazolin-3-one | 50 mg | |
| 2-Octyl-4-isothiazolin-3-one | 50 mg | |
| Fluorescent whitener (4,4'-diaminostilbene type) | 1.0 g | |
| Water to | 1000 ml | |
| pH | 7.5 | |

The pH was adjusted with potassium hydroxide or hydrochloric acid.

The magenta color density of the thus obtained color image was measured. The results are shown in Table 2.

TABLE 2

| Sample | Nucleating agent | Amount added per 1 mole of silver halide (mg) | 33° C. $D_{max}$ | 2.5 minutes $D_{min}$ | 33° C. $D_{max}$ | 3.5 minutes $D_{min}$ | |
|---|---|---|---|---|---|---|---|
| 1 | 12 | 80 | 2.2 | 0.10 | 2.3 | 0.11 | Present invention |
| 2 | 12 | 40 | 2.1 | 0.10 | 2.3 | 0.11 | Present invention |
| 3 | 9 | 30 | 2.3 | 0.09 | 2.3 | 0.11 | Present invention |
| 4 | 9 | 10 | 2.2 | 0.09 | 2.3 | 0.11 | Present invention |
| 5 | 20 | 5 | 2.2 | 0.10 | 2.2 | 0.11 | Present invention |
| 6 | 20 | 13 | 2.1 | 0.10 | 2.2 | 0.11 | Present invention |
| 7 | 50 | 10 | 2.0 | 0.10 | 2.1 | 0.11 | Present invention |
| 8 | 50 | 5 | 1.9 | 0.10 | 2.1 | 0.11 | Present invention |
| 9 | 41 | 300 | 1.9 | 0.10 | 2.1 | 0.11 | Present invention |
| 10 | 41 | 100 | 1.8 | 0.10 | 2.0 | 0.11 | Present invention |
| 11 | 39 | 300 | 2.2 | 0.10 | 2.2 | 0.11 | Present invention |
| 12 | 39 | 100 | 2.0 | 0.10 | 2.2 | 0.11 | Present invention |
| 13 | 65 | 10 | 1.8 | 0.10 | 2.1 | 0.11 | Present invention |
| 14 | 65 | 5 | 1.6 | 0.10 | 2.1 | 0.11 | Present invention |
| 15 | None | | 1.0 | 0.10 | 1.9 | 0.11 | Comparative example |

Sample Nos. 1 to 14 which contain the nucleating agent of the present invention, were high in the maximum density and low in the change in the maximum density when developing time changes, as compared with the case of the sample No. 15 which does not contain the nucleating agent of the present invention, and thus the sample Nos. 1 to 14 were preferable.

Example 2

The color photographic light-sensitive material Nos. 16 to 23 having the layer compositions shown in Table 4 were prepared and processed in the same manner as in Example 1, and then the magenta image density was measured. The sample Nos. 24 to 34 were prepared respectively in the same manner as in Sample Nos. 16 to 22 except that light fogging process was not conducted, and the magenta image density of Sample Nos. 24 to 34 was measured. In this connection, the same nucleating agent was added to the red-sensitive layer, green-sensitive layer and blue-sensitive layer in the same amount, respectively. The result are shown in Table 3.

TABLE 3

| Sample | Nucleating agent | Amount added per 1 mole of silver halide (mg) | 33° C. $D_{max}$ | 2.5 minutes $D_{min}$ | 33° C. $D_{max}$ | 3.5 minutes $D_{min}$ | |
|---|---|---|---|---|---|---|---|
| 16 | 12 | 80 | 2.4 | 0.12 | 2.5 | 0.13 | Present invention |
| 17 | 9 | 30 | 2.5 | 0.12 | 2.5 | 0.13 | Present invention |
| 18 | 20 | 5 | 2.3 | 0.12 | 2.4 | 0.13 | Present invention |
| 19 | 50 | 10 | 2.4 | 0.12 | 2.5 | 0.13 | Present invention |
| 20 | 41 | 300 | 2.2 | 0.12 | 2.5 | 0.13 | Present invention |
| 21 | 65 | 10 | 2.3 | 0.12 | 2.5 | 0.13 | Present invention |
| 22 | 39 | 300 | 2.3 | 0.12 | 2.5 | 0.13 | Present invention |
| 23 | None | — | 1.3 | 0.12 | 2.2 | 0.13 | Comparative example |
| 24 | 12 | 80 | 1.5 | 0.10 | 1.7 | 0.10 | Comparative example |
| 25 | 9 | 30 | 1.6 | 0.10 | 1.8 | 0.10 | Comparative example |
| 26 | 20 | 5 | 1.4 | 0.10 | 1.7 | 0.10 | Comparative example |
| 27 | 50 | 10 | 0.3 | 0.10 | 0.8 | 0.10 | Comparative example |
| 28 | 41 | 300 | 0.4 | 0.10 | 0.6 | 0.10 | Comparative example |
| 29 | 65 | 10 | 0.3 | 0.10 | 0.7 | 0.10 | Comparative example |
| 30 | 39 | 300 | 0.3 | 0.10 | 0.3 | 0.10 | Comparative example |

In both Sample No. 23 which does not contain the nucleating agent and Sample Nos. 24 to 30 to which the light fogging process was not applied, the maximum density was lower than Sample No. 16 to 22 of the present invention.

TABLE 4

| Layer | Main component | Amount used |
|---|---|---|
| The 7th layer (Protective layer) | Gelatin | 1.33 g/m$^2$ |
| | Acryl-modified polyvinyl alcohol copolymer (Modification degree 17%) | 0.17 g/m$^2$ |
| The 6th layer (UV absorbing layer) | Gelatin | 0.54 |
| | UV absorbant (h) | $5.10 \times 10^{-4}$ mol/m$^2$ |
| | Solvent (j) | 0.08 |
| The 5th layer (Blue-sensitive layer | Emulsion B (silver) | 0.40 g/m$^2$ |
| | Gelatin | 1.35 g/m$^2$ |
| | Yellow coupler (k) | $0.91 \times 10^{-4}$ mol/m$^2$ |
| | Color image-stabilizing agent (l) | 0.13 g/m$^2$ |
| | Solvent (m) | 0.02 g/m$^2$ |
| | Nucleating agent (shown in Table 3) | |
| The 4th layer (UV-absorbing layer) | Gelatin | 1.60 g/m$^2$ |
| | Colloidal silver | 0.10 g/m$^2$ |
| | UV absorbant (k) | $1.70 \times 10^{-4}$ mol/m$^2$ |
| | Color mixing inhibitor (i) | $1.60 \times 10^{-4}$ mol/m$^2$ |
| | Solvent (j) | 0.24 g/m$^2$ |
| The 3rd layer (Green-sensitive layer) | Emulsion B (silver) | 0.17 g/m$^2$ |
| | Gelatin | 1.56 g/m$^2$ |
| | Magenta coupler (e) | $3.38 \times 10^{-4}$ mol/m$^2$ |
| | Color image-stabilizing agent (f) | 0.19 g/m$^2$ |
| | Solvent (g) | 0.59 g/m$^2$ |
| | Nucleating agent (shown in Table 3) | |
| The 2nd layer (color mixing-inhibiting layer) | Gelatin | 0.90 g/m$^2$ |
| | Color mixing inhibitor (d) | $2.33 \times 10^{-4}$ mol/m$^2$ |
| The 1st layer (Red-sensitive layer) | Emulsion B (silver) | 0.39 g/m$^2$ |
| | Gelatin | 0.90 g/m$^2$ |
| | Cyan coupler (a) | $7.05 \times 10^{-4}$ mol/m$^2$ |
| | Color image-stabilizing agent (b) | $5.20 \times 10^{-4}$ mol/m$^2$ |
| | Solvent (c) | 0.22 g/m$^2$ |
| | Nucleating agent (shown in Table 3) | |
| Substrate | Polyethylene-laminated paper (A white pigment ($TiO_2$, etc.) and a bluish dye (ultramarine, etc.) are contained in the polyethylene of the 1st layer. | |

Example 3

Sample No. 15 prepared in Example 1, which does not contain a nucleating agent was processed in the same manner as in Example 1, using the following four developing solutions.

(1) The same developing solution as used in Example 1

(2) The developing solution obtained by adding 1 g/l of phenylhydrazine to the solution of (1)

(3) The developing solution obtained by adding 5 g/l of carbazinic acid to the solution of (1)

(4) The developing solution obtained by adding 0.1 g/l of the nucleating agent (9) to the solution of (1)

The results are shown in Table 5.

TABLE 5

| Sample | Developing agent | Light fogging process | 33° C. 2.5 minutes $D_{max}$ | $D_{min}$ | 33° C. 3.5 minutes $D_{max}$ | $D_{min}$ | |
|---|---|---|---|---|---|---|---|
| 31 | (1) | No | 0.10 | 0.10 | 1.9 | 0.11 | Comparative example |
| 32 | (1) | Yes | 1.0 | 0.10 | 1.9 | 0.11 | Comparative example |
| 33 | (2) | No | 1.2 | 0.10 | 1.9 | 0.11 | Comparative example |
| 34 | (2) | Yes | 1.2 | 0.10 | 1.8 | 0.11 | Comparative example |
| 35 | (3) | No | 1.3 | 0.10 | 2.0 | 0.11 | Comparative example |
| 36 | (3) | Yes | 1.3 | 0.10 | 1.9 | 0.11 | Comparative example |
| 37 | (4) | No | 1.0 | 0.10 | 2.0 | 0.11 | Comparative example |
| 38 | (4) | Yes | 1.7 | 0.10 | 2.1 | 0.11 | Present invention |

It is seen that even when the nucleating agent exists in the developing solution, the light-fogging process increases the maximum density remarkably. Further, it is seen that the development progresses in a short time by use of the nucleating agent described above.

Example 4

The same procedures as those in Example 1 was conducted except that the intensity of radiation of light fogging was changed from 0.5 lux to 0.1 lux.

The results are shown in Table 6.

TABLE 6

| Sample | Nucleating agent | Amount added (mg) | 33° C. 2.5 minutes $D_{max}$ | $D_{min}$ | 33° C. 3.5 minutes $D_{max}$ | $D_{min}$ |
|---|---|---|---|---|---|---|
| 39 | 12 | 80 | 2.0 | 0.10 | 2.1 | 0.11 |
| 40 | 9 | 30 | 2.1 | 0.09 | 2.1 | 0.11 |
| 41 | 20 | 5 | 2.0 | 0.10 | 2.0 | 0.11 |
| 42 | 50 | 10 | 1.8 | 0.10 | 1.9 | 0.11 |
| 43 | 41 | 300 | 1.7 | 0.10 | 1.9 | 0.11 |
| 44 | 39 | 300 | 2.0 | 0.10 | 2.0 | 0.11 |
| 45 | 65 | 10 | 1.6 | 0.10 | 1.9 | 0.11 |
| 46 | None | — | 0.50 | 0.10 | 1.1 | 0.10 |

It is seen from Table 6 that the latitude for expose amount is enlarged by using light fogging and the nucleating agent together.

The sensitizing dyes used in the above example are as follows.

Blue-sensitive emulsion layer;

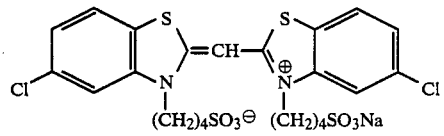

Green-sensitive emulsion layer;

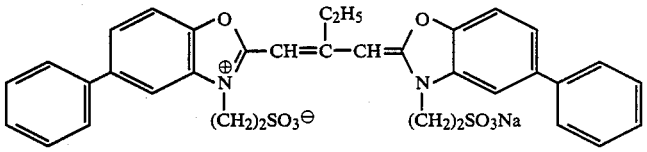

Red-sensitive emulsion layer;

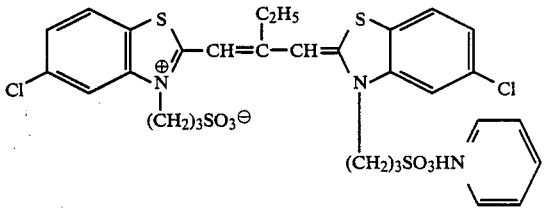

The following dyes were used as irradiation-preventing dyes in each of the emulsion layers.

Green-sensitive emulsion layer;

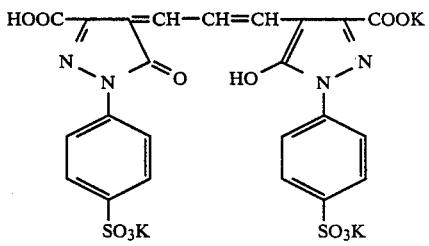

Red-sensitive emulsion layer;

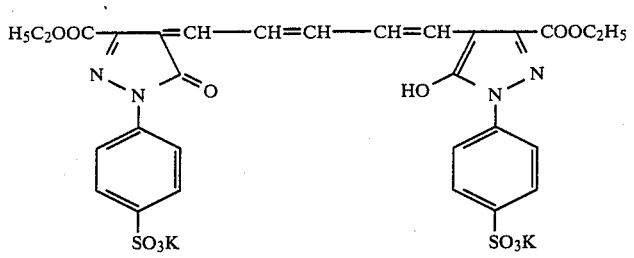
The chemical structures of the compounds such as couplers used in the present example are as follows.
(k) Yellow coupler
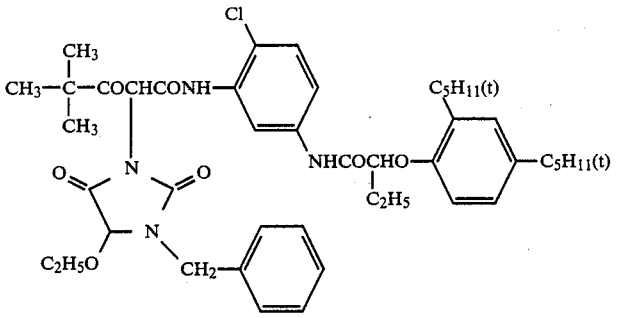
(l) Color image stabilizing agent
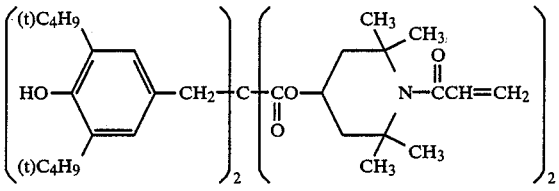
(m) Solvent
(iso $C_9H_{19}O)_3$—P=O
(d) Color mixing inhibitor
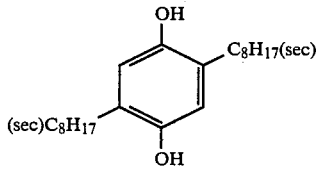
(e) Magenta coupler
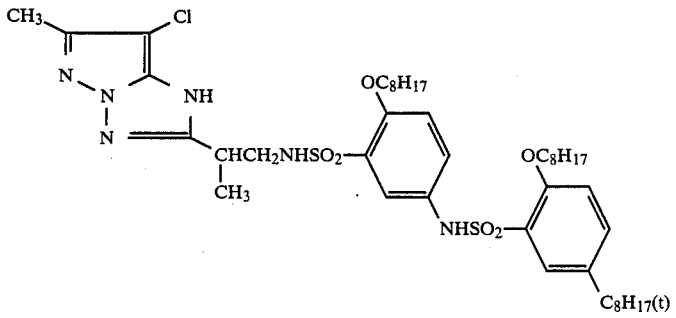
(f) Color image-stabilizing agent
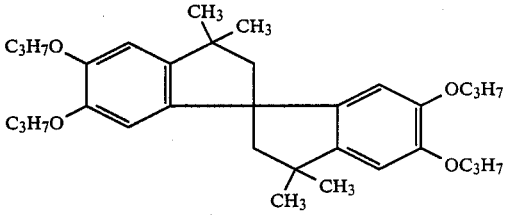
(g) Solvent
The mixture of
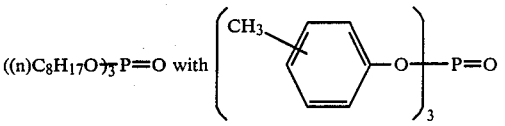
in the weight ratio of 2:1
(h) UV absorbant
The mixture of

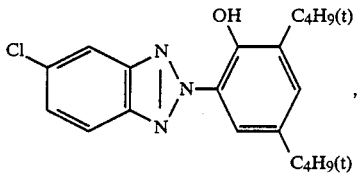

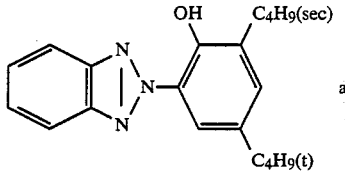

and

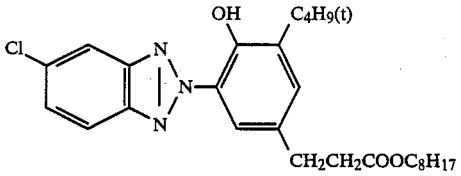

in the molar ratio of 1:5:3

(i) Color mixing inhibitor

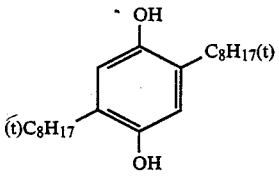

(j) Solvent (iso $C_9H_{19}O)_3$—P=O (a) Cyan coupler

The mixture of

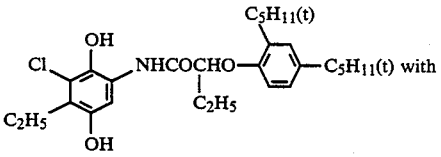

in the molar ratio of 1:1

(b) Color image-stabilizing agent

The mixture of

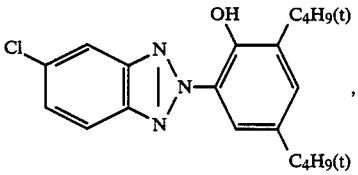

-continued

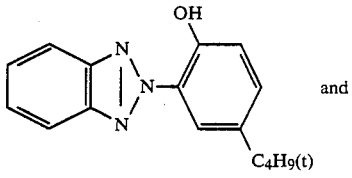

and

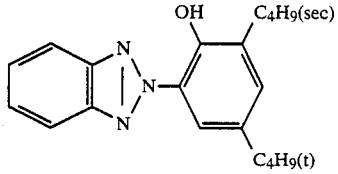

in the molar ratio of 3:3:3

(c) Solvent

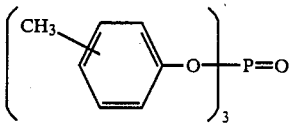

What is claimed is:

1. A process for forming a direct positive image which comprises image-wise exposing a light-sensitive material comprising a support having provided thereon at least one internal latent image type direct positive silver halide photographic emulsion layer, subjecting the resulting material to whole surface exposure before or during developing process, and developing the resulting material in the presence of (1) a quaternary salt nucleating agent represented by the general formula (N-I):

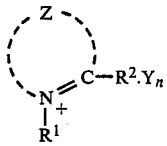

wherein, Z represents nonmetal atoms necessary for forming a 5- or 6-membered heterocyclic ring and may contain a substituent; $R^1$ is an aliphatic group; $R^2$ is a hydrogen atom, an aliphatic group or an aryl group: $R^1$ and $R^2$ may contain a substituent, provided that at least one of $R^1$, $R^2$ and Z groups contain at alkynyl group, an acyl group, a hydrazino group or a hydrazono group, or $R^1$ and $R^2$ are combined together to form dihydropyridinium skeleton as a 6-membered ring; further, at least one of $R^1$, $R^2$ and Z may contain $X^1$—($L^1$)— wherein $X^1$ is a group for promoting adsorption on silver halide and $L^1$ is a bivalent linking group; Y is a counter ion for electrical charge balance; n is 0 or 1; and m is 0 or 1 or a (2) hydrazine nucleating agent represented by the general formula (N-II);

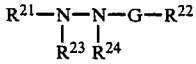

wherein, $R^{21}$ represents an aliphatic group, an aromatic group or a heterocyclic group, $R^{22}$ represents a hydrogen atom, an alkyl group, an aralkyl group, an aryl group, an alkoxy group, an aryloxy group or an amino group; G represents a carbonyl group, a sulfonyl group, a sulfoxy group, a phosphoryl group or an iminomethylene group

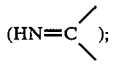

$R^{23}$ and $R^{24}$ are both hydrogen atoms, or one of them represents a hydrogen atom and the other represents any one of an alkylsulfonyl group, an arylsulfonyl group, or an acyl group, G, $R^{23}$, $R^{24}$ and hydrazine nitrogens may also form a hydrazone structure

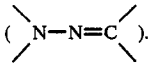

2. A process of claim 1, wherein the pH of the developing solution is 11.5 or less.

3. A process of claim 1, wherein pH of the developing solution is 11.0 or less.

4. A process of claim 1, wherein the whole surface exposure is conducted in the developing solution.

5. A process of claim 1, wherein the light-sensitive material is a direct positive silver halide color light-sensitive material containing at least two kinds of couplers which are different in spectral sensitivity distribution and in hue of formed dye from each other.

6. A process of claim 1, wherein the light-sensitive material is a direct positive silver halide color light-sensitive material which has at least one blue-sensitive silver halide emulsion layer containing a yellow dye-forming coupler, at least one green-sensitive silver halide emulsion layer containing a magenta dye-forming coupler, and at least one red-sensitive silver halide emulsion layer containing cyan dye-forming coupler.

7. A process of claim 1, wherein $R^{21}$ in the general formula (N-II) is an aromatic group having an ureido group as s substituent.

8. A process of claim 1, wherein $R^{21}$ in the general formula (N-II) is an aromatic group having a group for promoting adsorption on silver halide as a substituent as selected from a heterocyclic-mercapto group, an arylmercapto group, an aliphatic-mercapto group and a nitrogen-containing heterocyclic group which forms imino silver.

9. A process of claim 1, wherein the heterocyclic ring as completed with Z in the general formula (N-I) is selected from a quinolinium, benzothiazolium, benzimidazolium, pyridinium, acridinium, phenanthridinium and isoquinolinium nucleus.

10. A process of claim 1, wherein the group for promoting adsorption on silver halide as represented by $X^1$ in the general formula (N-I) is a thioamido group, a heterocyclic-mercapto group or a nitrogen-containing heterocyclic group which forms imino silver.

11. A process of claim 1, wherein the heterocyclic ring as completed with Z in the general formula (N-I) is quinolinium, benzothiazolium or benzimidazolium.

12. A process of claim 1, wherein the heterocyclic ring as completed with Z in the general formula (N-I) is quinolinium or benzothiazolium.

13. A process of claim 1, wherein the heterocyclic ring as completed with Z in the general formula (N-I) is quinolinium.

14. A process of claim 1, wherein the substituent of $R^1$, $R^2$ or Z is an alkynyl group.

15. A process of claim 14, wherein the heterocyclic ring as completed with Z in the nucleating agent is quinolinium.

16. A process of claim 15, wherein the nucleating agent has a group for promoting adsorption on silver halide represented by $X^1$.

17. A process of claim 16, wherein the group for promoting adsorption on silver halide is a thioamido group, a heterocyclic-mercapto group or a nitrogen-containing heterocyclic group which forms imino silver.

18. A process of claim 1, wherein the group represented by $G\text{-}R^{22}$ in the general formula (N-II) is a formyl group.

19. A process of claim 1, wherein $R^{23}$ and $R^{24}$ are hydrogen atom and the group represented by $G\text{-}R^{22}$ is a formyl group in the general formula (N-II).

20. A process of claim 19, wherein $R^{21}$ in the general formula (N-II) is an aromatic group having either a group for promoting adsorption on silver halide as a substituent selected from a heterocyclic-mercapto group and a nitrogen-containing heterocyclic group which forms imino silver, or an ureido group.

* * * * *